US007684033B2

(12) United States Patent
Engels et al.

(10) Patent No.: US 7,684,033 B2
(45) Date of Patent: Mar. 23, 2010

(54) APPARATUS AT A SPINNING PREPARATORY PLANT FOR DETECTING FOREIGN OBJECTS IN FIBRE MATERIAL

(75) Inventors: Guido Engels, Rommerskirchen (DE); Franz Nohr, Jüchen (DE); Konrad Temburg, Möchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 11/987,351

(22) Filed: Nov. 29, 2007

(65) Prior Publication Data

US 2008/0129989 A1 Jun. 5, 2008

(30) Foreign Application Priority Data

Dec. 1, 2006 (DE) ..... 10 2006 057 215

(51) Int. Cl.
*G01N 21/00* (2006.01)
*G01N 21/84* (2006.01)

(52) U.S. Cl. ..... 356/238.3; 356/238.1; 356/238.2; 356/429; 356/430

(58) Field of Classification Search ..... None
See application file for complete search history.

(56) References Cited

U.S. PATENT DOCUMENTS

| | | | | |
|---|---|---|---|---|
| 3,030,853 | A * | 4/1962 | Strother | 356/431 |
| 5,130,559 | A * | 7/1992 | Leifeld et al. | 250/559.11 |
| 5,194,911 | A | 3/1993 | Stutz | |
| 5,355,561 | A | 10/1994 | Faas | |
| 5,459,318 | A | 10/1995 | Cacho et al. | |
| 5,495,333 | A | 2/1996 | Konda et al. | |
| 6,087,608 | A * | 7/2000 | Schlichter et al. | 209/580 |
| 6,188,479 | B1 * | 2/2001 | Shofner et al. | 356/429 |
| 6,452,157 | B1 * | 9/2002 | Hosel | 250/227.14 |
| 2004/0065830 | A1 | 4/2004 | Boon et al. | |
| 2004/0195156 | A1 * | 10/2004 | Losbrock et al. | 209/577 |
| 2005/0078306 | A1 * | 4/2005 | Engels | 356/238.3 |

FOREIGN PATENT DOCUMENTS

| | | | |
|---|---|---|---|
| DE | 102005014898 | A1 | 10/2006 |
| WO | WO 2007/051335 | A1 | 5/2007 |

OTHER PUBLICATIONS

British Search Report dated Mar. 12, 2008, issued in Application No. GB0723421.4.

* cited by examiner

*Primary Examiner*—Tarifur Chowdhury
*Assistant Examiner*—Gordon J Stock, Jr.
(74) *Attorney, Agent, or Firm*—Venable LLP; Robert Kinberg; Steven J. Schwarz

(57) ABSTRACT

In an apparatus at a spinning preparatory plant for detecting foreign objects, for example, pieces of cloth, tapes, string, pieces of sheeting and the like, in fibre material, the fibre material is transportable in an air flow through a fibre transport duct or a feed chute and an optical sensor system is associated with the duct or chute, the wall surfaces of which have at least one transparent region through which the sensor system detects the fibre-air flow. To permit the at least one transparent region to be kept clean in a simple manner during operation, and to permit an unobstructed detection of the foreign objects, the transparent region projects into the fibre-air flow and the fibre-air flow is able to flow along the transparent region in force-applying contact therewith.

20 Claims, 6 Drawing Sheets

APPARATUS AT A SPINNING PREPARATORY PLANT FOR DETECTING FOREIGN OBJECTS IN FIBRE MATERIAL

CROSS REFERENCE TO RELATED APPLICATION

The present application claims priority from German Patent Application No. 10 2006 057 215.7, dated Dec. 1, 2006, the entire disclosure of which is incorporated herein by reference.

BACKGROUND OF THE INVENTION

The invention relates to an apparatus at a spinning preparatory plant for detecting foreign objects, for example, pieces of cloth, tapes, string, pieces of sheeting and the like in the fibre material, for example, cotton and/or synthetic fibres.

It is known, in a spinning preparatory installation, in which the fibre material is transportable in a current of air through a fibre transport duct or a feed chute and an optical sensor system is associated with the fibre transport duct or the feed chute, for the wall surfaces of the duct or chute to have at least one transparent region through which the sensor system detects the fibre-air flow.

In the case of a known apparatus (DE 10 2005 014 898 A1), the fibres are transported through a partially transparent channel. In this apparatus, the transparent regions of the channel are arranged flush with the non-transparent regions of the channel wall. The transparent region and the flow of fibre and air run parallel to one another. This arrangement is chosen because it is assumed that it has no affect on the flow properties and there is a belief that the transparent regions have to be protected from, that is, kept away from, the contaminating and degrading action of the fibre material. In terms of construction, this arrangement can be manufactured inexpensively. One problem in the operation of this optically functioning foreign part detector is that the necessary interface, usually glass or plastics, between the area of the fibre material flow and the area with the optical components becomes contaminated with the substances contained in the fibre material, such as dust, honeydew or finishing agents, or impurities carried along in the fibre-air flow. This contamination impairs the function of the foreign part detector, thus necessitating service intervals for cleaning that are unacceptable to the operators. The same problems exist in the application of optical measuring apparatus that looks into fibre-carrying channels of spinning preparatory machines.

SUMMARY OF THE INVENTION

It is an aim of the invention to produce an apparatus of the kind described initially that avoids or mitigates the said disadvantages and which in particular in a simple manner permits the at least one transparent region to be kept clean in operation and allows the foreign objects to be detected without hindrance.

The invention provides an apparatus for detecting foreign objects in fibre material, in which the fibre material is transportable in a current of air through a pathway that is enclosed by wall surfaces having at least one transparent region and an optical sensor system is arranged to detect the fibre-air flow through a said transparent region, wherein a said transparent region with which the sensor system is associated extends into the fibre-air flow and the fibre-air flow is able to flow along the transparent region in force-applying contact therewith.

Because the fibre-air flow flows during operation along the transparent region in force-applying contact therewith, self-cleaning is effected in a simple manner. In this case, the cleaning action of the fibre-air flow is greater than the contaminating action; any impurities deposited are wiped away. The transparent region, for example, a glass pane, is advantageously protected in this way from contamination by substances contained in the fibre material, or by impurities carried along in the fibre-air flow outside the fibre material. The contact force is essentially brought about by the fibre-air flow impacting the transparent region. The contact force is preferably reinforced by the fact that the transparent region constricts the cross-section of the fibre transport duct, with the result that the pressure of the fibre-air flow increases.

In one preferred embodiment, the transparent region comprises glass or the like. In another preferred embodiment, the transparent region comprises plastics material. Advantageously, the glass or plastics face is in the form of a window, especially a pane. Preferably, the transparent region of the wall surface is not set back, for example, the panes are not set back with respect to the pipe or feed chute wall. Advantageously, the fibre-air flow is directed onto the transparent region, for example, the fibre-air flow impacts the transparent region. The transparent region, for example, the glass pane, may be set out into the fibre-air flow. As well, or instead, the transparent region, for example, the glass pane, may be inclined into the fibre-air flow. The inclination of the transparent region, for example, the glass pane, may be achieved by a constriction of the fibre transport duct in the direction of flow of the material. Advantageously, the fibre material-carrying ducts or feed chute walls are arranged so that the fibre material flow leads continuously over the transparent region, for example, the glass pane, and at a shallow angle in contact therewith. In certain embodiments, the fibre transport duct has a rectangular or square cross-section. In further embodiments, the fibre transport duct is tubular, for example, the fibre transport duct may have a circular cross-section. Expediently, the apparatus is arranged in a spinning preparatory plant (blow room). For example, the apparatus may be arranged upstream and/or downstream of blow room machines, for example, cleaners, mixers. Advantageously, the fibre transport duct is a fibre waste duct. Advantageously, at least two transparent regions are present, the transparent regions preferably lying opposite one another. Advantageously, the transparent regions form at least partly a channel, a duct, a feed chute or the like. Advantageously, lighting equipment is present, which shines light through a transparent region into the fibre transport duct. In some embodiments, the optical sensor system and the lighting equipment are arranged on different sides of the fibre transport duct or the like. Advantageously, the optical sensor system then detects the fibre-air flow through a first transparent region and the lighting equipment shines light through a second transparent region into the fibre transport duct or the like. In other embodiments, the optical sensor system and the lighting equipment are arranged on the same side of the fibre transport duct or the like. The optical coverage system may comprise at least one camera. Advantageously, the fibre-air flow passes through a glass channel. Preferably, the glass channel comprises two opposing glass panes. Advantageously, the glass panes are rectangular. In certain embodiments, the long sides of the rectangular glass panes extend substantially perpendicular to the direction of the fibre-air flow. The long sides of the rectangular glass panes preferably extend across the entire width of the fibre transport duct or the like. Preferably, the inner surfaces of the transparent regions, for example, the glass panes, are arranged at a shallow (acute) angle, for example from 5 to 20°, preferably less than 10°, in relation to the direction of the fibre-air flow. Preferably, the shallow angle is adjustable. Advantageously, the glass channel is arranged in a support element on an aluminum extruded profile. The glass channel may be rotatable about its longitudinal axis. Advantageously, the aluminum extruded profile for the glass channel has two profiles, for example, aluminum profiles, in the form of a segment of a circle. The aluminum extruded profile with the glass channel is advantageously rotatable about its longitudinal axis. Advantageously, the aluminum extruded profile with the glass channel is rotatably arranged in a guide element, for example, an aluminum guide profile. In certain embodiments, the transparent regions, for example, the glass panes, each have a polarization filter. For example, the transparent regions through which the lighting equipment shines light into the fibre transport duct or the like may each have a polarization filter, or glass panes with polarization filters may be arranged between the transparent region of the glass channel and the lighting equipment. In some embodiments, the lighting equipment comprises at least one neon tube. In certain embodiments, the lighting equipment is provided for transmitted light. A cooling device, for example, a fan, may be associated with the lighting equipment. Advantageously, the housing for the lighting equipment has cooling fins. Advantageously, a separation device for separating out the foreign objects is arranged downstream of the optical sensor system, for example, the camera. As well or instead, the optical sensor system, for example, the camera, may be arranged downstream of a separation device for separating out the foreign objects. Advantageously, the optical sensor system is connected by way of an evaluating device and a control device to the separation device. Advantageously, the separation device is associated with the fibre transport duct or the like. In practice, the apparatus is suitable for detecting foreign objects comprising polypropylene, for example, polypropylene bands, fabric and sheeting and the like present in or between fibre tufts for example, of cotton and/or synthetic fibres. Advantageously, the optical sensor system comprises a transmitter and a receiver for electromagnetic waves or rays and an evaluating device for distinguishing the foreign parts from the fibre tufts. Advantageously, a source of polarized light acts on the fibre material (fibre tufts, fibre tuft fleece), and cooperates with at least one detector arrangement (camera), wherein the fibre material is illuminated by trans-illumination of light-coloured and/or transparent sheet-form foreign objects of polypropylene and the detector arrangement is capable of discerning sheet-form polypropylene parts. The foreign objects comprising polypropylene parts typically rotate the polarization vector of the polarized light. Advantageously, a depolarization is effected for detection. Any suitable detector arrangement may be used as the sensor system. For example, the detector arrangement may be or include a line scan camera, a matrix camera, or light sensors. Detection may be effected with colour or with black and white. Advantageously, a polarizer is arranged between light source and fibre material. A light source emitting polarized light may be present. For example, the polarizer may be integrated on or within the light source (lighting equipment). In use, the apparatus of the invention may be arranged in or downstream of any of the following: a cleaning apparatus; a card; a foreign fibre separator; or a foreign fibre separator.

The invention also provides an apparatus at a spinning preparatory plant for detecting foreign objects, for example, pieces of cloth, tapes, string, pieces of sheeting and the like in the fibre material, for example, cotton and/or synthetic fibres, in which the fibre material is transportable in a current of air through a fibre transport duct or a feed chute and an optical sensor system is associated with the fibre transport duct or the feed chute, the wall surfaces of which have at least one transparent region through which the sensor system detects the fibre-air flow, in which the transparent region extends into the fibre-air flow and the fibre-air flow is able to flow along the transparent region in force-applying contact therewith.

DETAILED DESCRIPTION OF CERTAIN PREFERRED EMBODIMENTS

Figure 1:
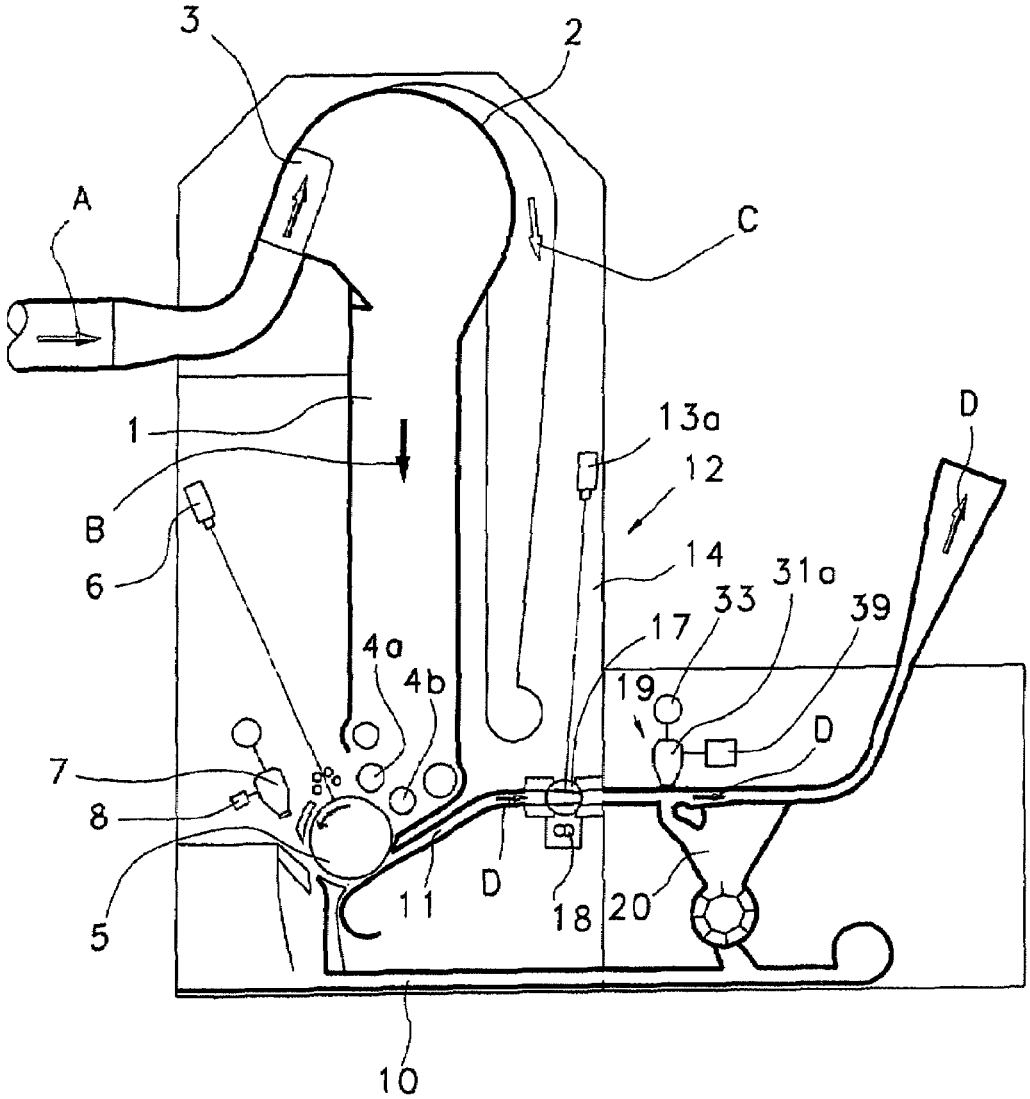
FIG. 1 shows apparatus according to a first embodiment of the invention on a foreign part detection and separation device.

Referring to FIG. 1, in an apparatus for detecting and separating foreign objects, e.g. the foreign part separator SECUROMAT SP-F2 made by Trützschler GmbH & Co. KG of Mönchengladbach, Germany, the upper inlet opening of a feed chute 1 has associated with it an arrangement for the pneumatic supply of a fibre-air flow A, which comprises a fibre material transport fan (not shown), a stationary air-permeable surface 2 for removal (separation) of the fibre material B from air C with air extraction, and an air flow guide means 3 with movable elements; the fibre material present in the air flow is guided reversibly backwards and forwards transversely over the air-permeable surface 2 and, following impact, the fibre material falls substantially as a result of gravity from the air-permeable surface 2 and enters the feed chute 1 downwards. The slow-speed rollers 4*a*, 4*b* have a dual function: they serve as take-off rolls for the fibre material B out of the feed chute 1 and at the same time as feed rolls for supplying the fibre material B to a high-speed opening roll 5.

The solid arrows represent fibre material, the empty arrows represent air and the half-filled arrows represent an air current with fibres.

Figure 5:
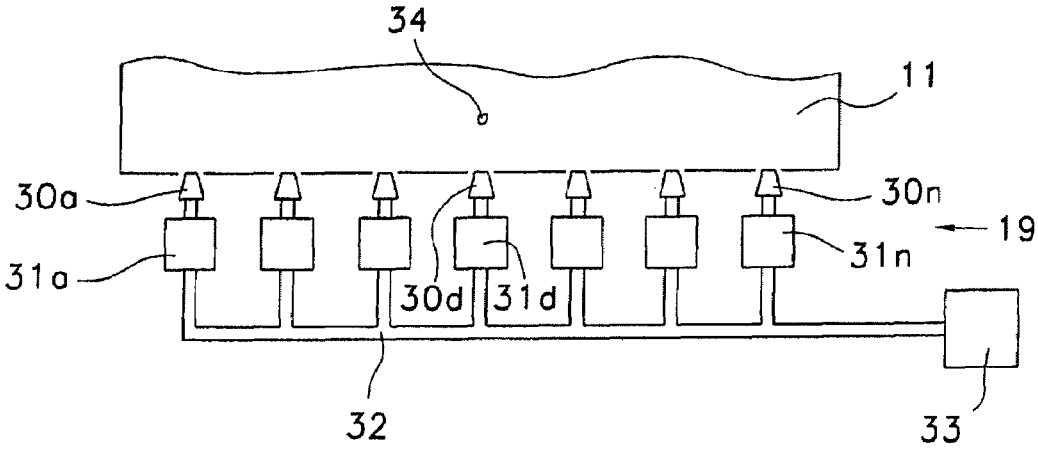
FIG. 5 is a plan view of one form of blow-out system with a plurality of blast nozzles arranged across the width suitable for use in the apparatus of FIG. 1 or FIG. 2.

An optical sensor system 6, for example, a line-scan camera 6 (CCD camera) with an electronic evaluating device for the detection of foreign objects, especially with brightness and/or colour variations, is associated with the total surface area of the opening roll 5. The sensor system 6 is connected by way of an electronic control and regulating device 35 (see FIG. 6) to an arrangement 7 for separating the foreign objects (see FIG. 5). The arrangement 7 is capable of generating a short blast air current, which travels towards the clothed face surface and creates a suction air flow, which detaches the foreign objects together with a few fibres from the clothed face and removes them in a channel 10.

The optical sensor system 6 with the camera, for example, a colour line-scan camera, is arranged obliquely above the opening roll 5 close to the outer wall of the feed chute 1. This produces a compact, space-saving construction. The colour line-scan camera 6 is directed towards the clothing of the opening roll 5 and is able to detect coloured foreign objects, for example, red fibres, in the fibre material. The camera 6 covers the entire region across the width of the opening roll 5, e.g. 1600 mm. The opening roll 5 rotates anticlockwise in the direction of the curved arrow. Downstream of the optical sensor system 6 in the direction of rotation is the arrangement 7 for producing a blast air current, the nozzles of which are oriented towards the clothed face of the opening roll 6, so that a short, sudden jet of air flows tangentially in relation to the clothed face. The sensor system 6 is connected by way of an evaluating device and the electronic control and regulating device to the arrangement 7, with which there is associated a valve control means 8. When the camera 6 has detected foreign objects in the fibre material on the clothed surface using comparative and desired values, using the valve control means 8 a short air blast is expelled at high speed in relation to the clothing and tears the foreign objects with a few fibres out of the fibre covering on the clothing by a suction air current, and subsequently carries them away through a channel 10 under suction.

A blast air current flows through a channel approximately tangentially to the opening roll 5, detaches the fibre covering (good fibres) from the clothing and flows away as a fibre-air flow D through a fibre transport duct 11 to the glass channel 17.

A first embodiment, according to the invention, in the form of apparatus 12, is associated with the pneumatic fibre transport duct 11. The apparatus 12 is suitable for detecting foreign objects of any kind, for example, pieces of cloth, tapes, string, pieces of sheeting etc, in the fibre material. According to an advantageous construction, the apparatus 12 is used to detect foreign particles of plastics material, such as polypropylene bands, fabric and sheeting or the like in or between fibre tufts, for example, of cotton and/or synthetic fibres.

In the case of the apparatus 12 for detecting foreign objects, the fibre material is transported in an air flow (fibre-air flow D) through a pneumatic fibre transport duct 11, which is connected to a suction source (not shown). As the optical sensor system, two cameras 13*a*, 13*b*(shown in FIG. 6), for example, diode array cameras with polarization filters, are arranged in a housing 14 above the fibre transport duct 11 across the machine width, which is, for example, 1600 mm. Beneath the cameras 13*a*, 13*b* (shown in FIG. 6), the wall surfaces of the fibre transport duct 11 have two transparent regions in the form of two parallel and opposite glass panes 17*a*, 17*b* (glass windows—see e.g. FIG. 3), which form a glass channel 17. Lighting equipment 18 is provided beneath the fibre transport duct 11. Downstream of the glass channel 17, a blow-out device 19 for separation of the foreign objects 34 (see FIG. 5) detected by the apparatus 12 is associated with the fibre transport duct 11. Downstream of the blow-out device 19, the fibre-air flow D is sucked through the fibre transport duct 11 and fed onwards for further processing.

In operation, the camera 13*a* detects the fibre-air flow D through the glass pane 17*a*. Here, the glass pane 17*a* projects into the fibre-air flow D in such a way that the fibre-air flow D meets the glass pane 17*a* and flows along and in force-applying contact with the glass pane 17*a*. Through the movement of the fibre-air flow D, on the one hand unwanted deposits on the glass pane 17*a* are largely or completely avoided and, if slight deposits do occur, they are wiped off the inner surface of the glass pane 17*a* by the fibre-air flow D and carried away through the duct 11. The fibre-air flow D has a similar effect on the inner surface of the glass pane 17*b*.

If unwanted foreign objects 34 (see FIG. 5) are detected in the fibre-air flow D by the apparatus 12, the blow-out device 19 is activated and blows the foreign objects 34 (see FIG. 5) into a suction channel 20.

Figure 2:
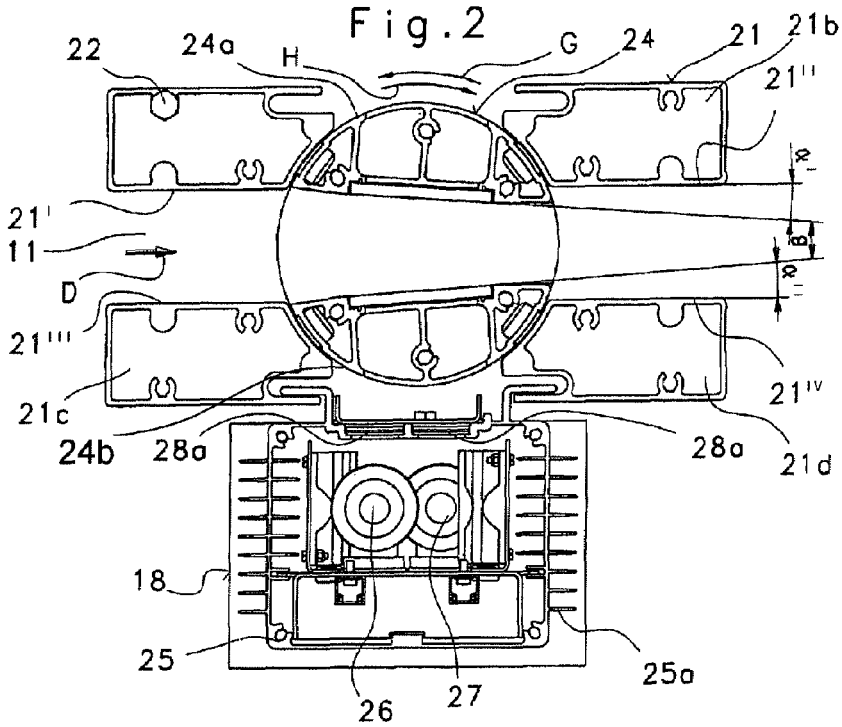
FIG. 2 is a schematic side view of a holding device with a channel and lighting equipment.
Figure 2A:
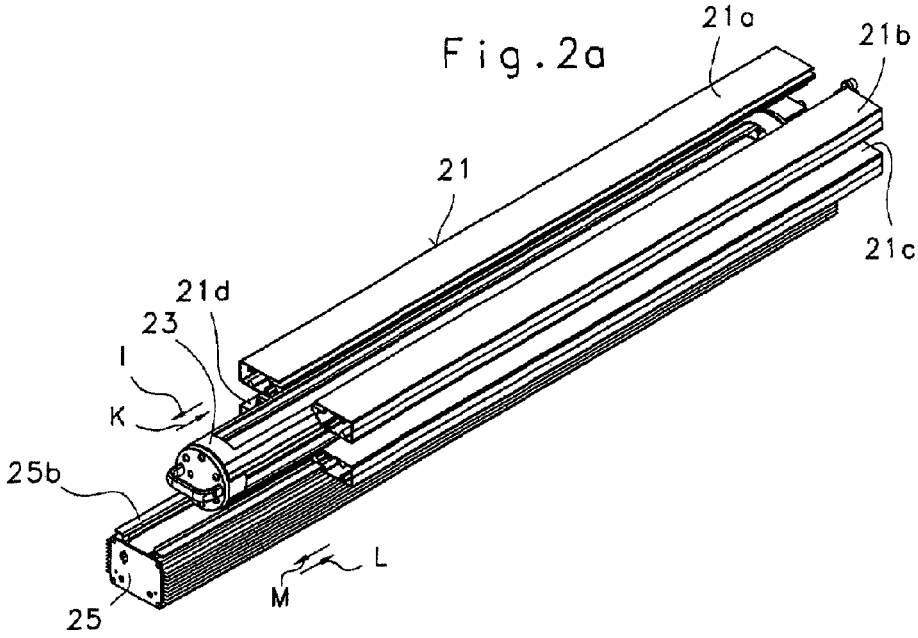
FIG. 2*a* is a perspective view of the holding device, the housing for the glass channel and the housing for the lighting equipment of the apparatus shown in FIG. 2.
Figure 3:
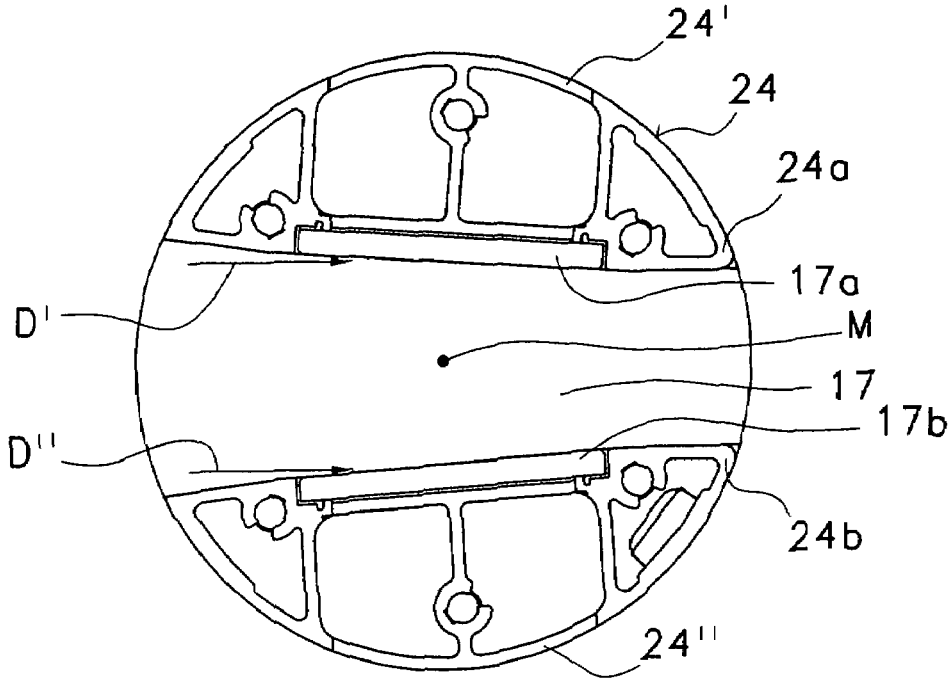
FIG. 3 is a side view of the supporting element comprising two support profiles shown in FIG. 2 with two opposing glass panes arranged at an angle to one another.

As shown in FIG. 2, a holding device 21 is provided, which comprises four extruded aluminum hollow profiles 21*a*, 21*b*, 21*c*, 21*d* (holding profiles), which are parallel to one another in the longitudinal direction—across the machine width—and are each fixed by their front faces to the two framework walls of the machine. As an example, a fixing bolt 22 is shown on the extruded profile 21*a*. The internal flat faces $\mathbf{21}^{I}$, $\mathbf{21}^{II}$, $\mathbf{21}^{III}$, and $\mathbf{21}^{IV}$, form part of the inner circumferential surface of the fibre transport duct 11. The faces $\mathbf{21}^{I}$ and $\mathbf{21}^{II}$ on the one hand and the faces $\mathbf{21}^{III}$ and $\mathbf{21}^{IV}$ on the other hand are arranged parallel to one another. The facing lateral regions of the extruded profiles 21*a* to 21*d* each have a concave face in the form of a portion of a cylinder surface. A housing 23 (FIG. 2*a*), which is rotatable in the direction of the arrows G, H about its longitudinal axis M (see FIG. 3) is located between and in contact with the four faces in the form of a portion of a cylinder surface. The housing 23 comprises a support element 24 of two extruded aluminum hollow profiles 24*a*, 24*b* (support profiles), which in cross-section are each constructed as a portion of a cylinder. The external contour of the housing 23 is circular. The convexly rounded external faces of the support profiles 24*a*, 24*b* engage with the faces of the holding profiles 21*a*, 21*b* and 21*c*, 21*d* respectively that are concavely rounded and in the form of a portion of a cylinder shell. As shown in FIG. 3 in more detail, flat glass panes 17*a*, 17*b* are arranged in the flat chord faces of the support profiles 24*a*, 24*b* respectively, the chord faces and the external faces of the glass panes 17*a*, 17*b* aligning with one another. The two opposing faces each formed in this way by chord faces and glass panes 17*a*, 17*b* respectively form part of the fibre transport duct 11, which narrows in the direction of the fibre-air flow D. The two opposing faces of the glass panes 17*a*, 17*b* form a glass channel 17, which likewise tapers conically in the direction of the fibre-air flow D.

The face formed by the faces $\mathbf{21}^{I}$, $\mathbf{21}^{II}$ forms an acute and shallow angle $\alpha^{I}$ with the face of the support element 24*a* formed by the chord face and glass pane 17*a*, and the face formed by the faces $\mathbf{21}^{III}$, $\mathbf{21}^{IV}$ forms an acute and shallow angle $\alpha^{II}$ with the face of the support profile 24*b* formed by the chord face and glass pane 17*b*. The conically converging faces of the two opposing faces, each comprising a chord face and a respective glass pane 17*a*, 17*b*, form an angle $\beta$.

Lighting equipment 18 is present beneath the housing 23 for the glass channel 17, having a housing 25 that is mounted in guide grooves on the holding profiles 21*c*, 21*d*, extending across the width of the machine. Inside the housing 25 two fluorescent tubes 26, 27, for example, neon tubes, are arranged parallel side by side and extend with their longitudinal axes across the working width of the machine. The housing 25 is an aluminum extruded hollow profile with cooling fins 25*a*. Elongate glass panes 28*a*, 28*b* with polarization filters are mounted in the top face 25*b* of the housing 25 facing the housing 23 for the glass channel 17. The polarization filters (not shown) of the cameras 13*a*, 13*b* on the one hand and the polarization filters (not shown) of the glass panes 28*a*, 28*b* on the other hand are arranged at a right angle to one another.

Lighting equipment 18 is present beneath the housing 23 for the glass channel 17, having a housing 25 that is mounted in guide grooves on the holding profiles 21*c*, 21*d*, extending across the width of the machine. Inside the housing 25 two fluorescent tubes 26, 27, for example, neon tubes, are arranged parallel side by side and extend with their longitudinal axes across the working width of the machine. The housing 25 is an aluminum extruded hollow profile with cooling fins 25*a*. Elongate glass panes 28*a*, 28*b* with polarization filters are mounted in the top face 25*b* of the housing 25 facing the housing 23 for the glass channel 17. The polarization filters (not shown) of the cameras 13*a*, 13*b* (see FIG. 6) on the one hand and the polarization filters (not shown) of the glass panes 28*a*, 28*b* on the other hand are arranged at a right angle to one another.

In FIG. 3, a partial air flow $D^I$, for example, of the fibre-air flow D meets the inner face of the glass pane 17*a* at a shallow, acute angle and thus exerts a force. Correspondingly, a partial air flow $D^{II}$, for example, of the fibre-air flow D meets the inner face of the glass pane 17*b* at a shallow, acute angle and thus exerts a force. The force is further reinforced by the fact that the two opposing faces of the glass panes 17*a*, 17*b* of the glass channel 17 converge conically, that is the glass channel tapers and the pressure p of the fibre-air flow D consequently increases. After impact, the partial air currents $D^I$ and $D_{II}$, flow along and in contact with the glass panes 17*a* and 17*b* and are subsequently sucked through the channel 11.

In the convexly curved outer surface of the support elements 24*a*, 24*b*, a continuous, elongate, slit-form opening $\mathbf{24}^I$, $\mathbf{24}^{II}$ respectively is formed opposite the glass pane 17*a* respectively 17*b*. The cameras 13*a*, 13*b* (see FIG. 1) detect the fibre-air flow D in the glass channel $\mathbf{17}^I$ through the opening $\mathbf{24}^{II}$ and through the glass pane 17*a*. Through the glass panes 28*a*, 28*b* with polarization filters, through the opening $\mathbf{24}^{II}$ and through the glass pane 17*b*, the fluorescent tubes 26, 27 illuminate the fibre-air flow D in the glass channel 17 with transmitted light.

In the convexly curved outer surface of the support elements 24*a*, 24*b*, a continuous, elongate, slit-form opening 24.sup.I, 24.sup.II respectively is formed opposite the glass pane 17*a* respectively 17*b*. The cameras 13*a*, 13*b* (see FIG. 6) detect the fibre-air flow D in the glass channel $\mathbf{17}^I$ through the opening $\mathbf{24}^{II}$ and through the glass pane 17*a*. Through the glass panes 28*a*, 28*b* with polarization filters, through the opening $\mathbf{24}^{II}$ and through the glass pane 17*b*, the fluorescent tubes 26, 27 illuminate the fibre-air flow D in the glass channel 17 with transmitted light.

Figure 4:
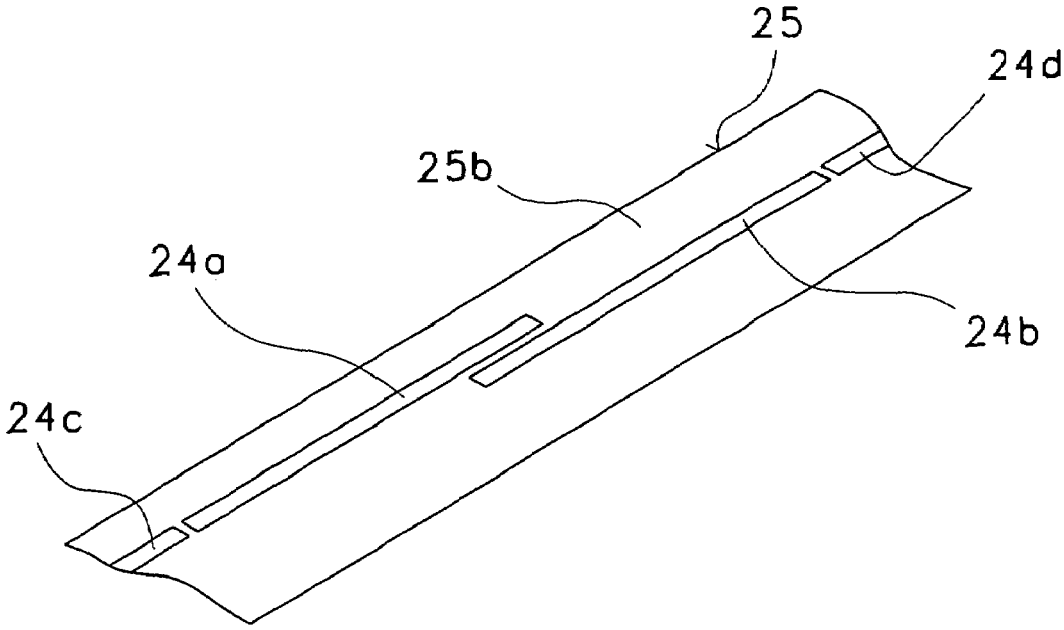
FIG. 4 is a perspective view of a portion of the housing of the lighting equipment shown in FIG. 2, arranged in the top surface of which are glass panes with polarization filters.

Referring to FIG. 4, in one form of housing 25 for lighting equipment for use in an apparatus according to the invention, in the top surface 25*b* of the housing 25 in a row one behind the other are two elongate glass panes 24*a*, 24*c* and parallel and offset thereto one behind the other in a row are two elongate glass panes 24*b*, 24*d*. The glass panes 24*a*, 24*c* are associated with the cameras 13*a* and the glass panes 24*b*, 24*d* with the camera 13*b* (see FIG. 6).

Figure 6:
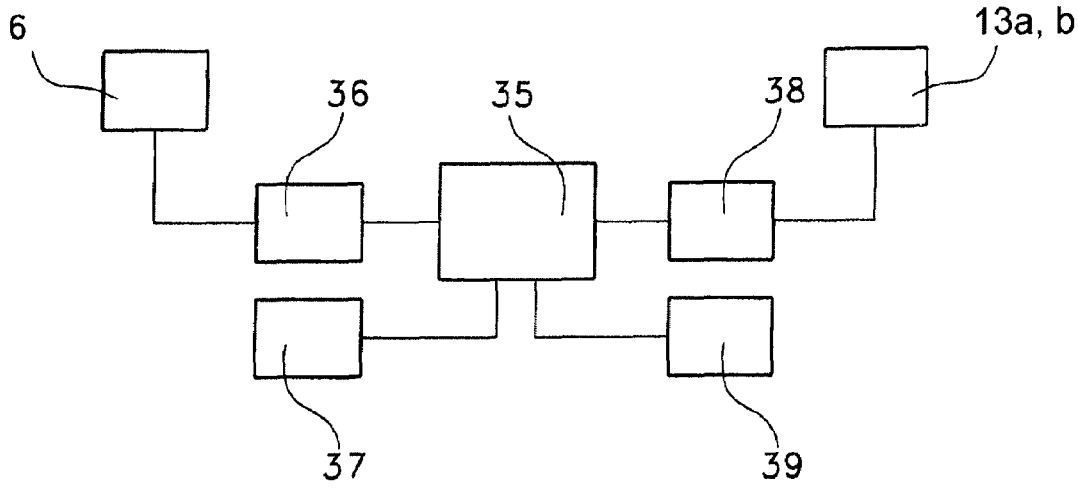
FIG. 6 is a block diagram of one form of electronic control and regulating device suitable for use in an apparatus having two sensor systems and two blow-out systems are connected.
Figure 7:
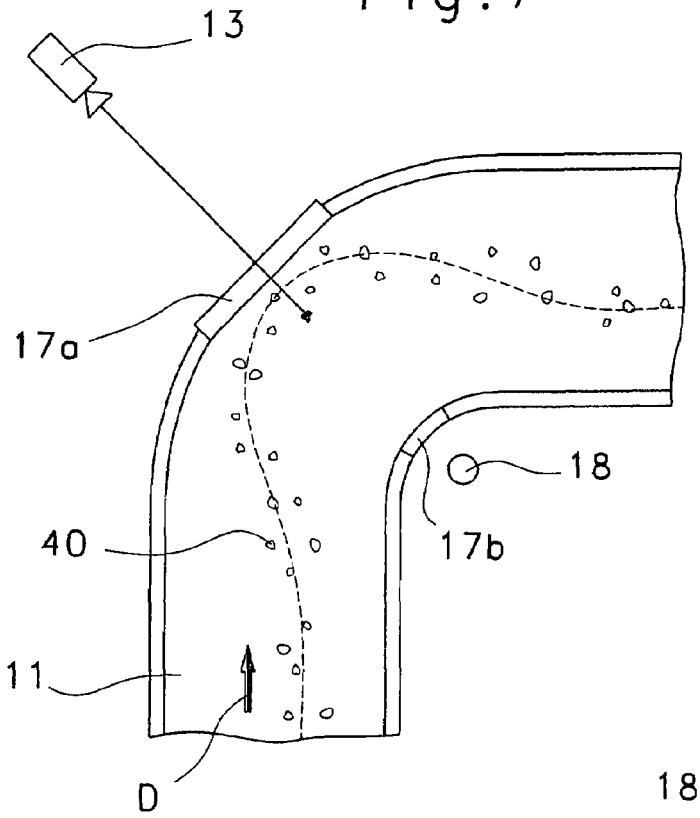
FIG. 7 shows a pneumatic fibre transport duct, in the outside bend region of which there is a glass pane that projects into the fibre-air flow or forms an angle to it.
Figure 7A:
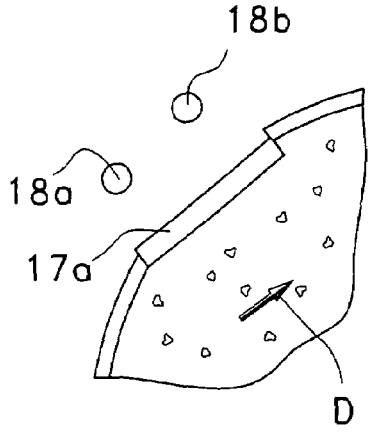
FIG. 7*a* shows a construction as in FIG. 7, in which the glass pane is angled into the fibre-air flow.

In the illustrative control arrangement of FIG. 6, the camera 6, an image evaluating device 36 and a valve control means 37 for the valves of the blow-out device 7 are connected to an electronic control and regulating device 35. In addition, cameras 13*a*, 13*b*, an image evaluating device 38 and the valve control means 39 for the valves 31*a* to 31*n* of the blow-out device 19 are connected to the electronic control and regulating device 35.

In the illustrative control arrangement of FIG. 6, the camera 6, an image evaluating device 36 and a valve control means 37 for the valves of the blow-out device 7 are connected to an electronic control and regulating device 35. In addition, cameras 13*a*, 13*b* (see FIG. 6), an image evaluating device 38 and the valve control means 39 for the valves 31*a* to 31*n* of the blow-out device 19 are connected to the electronic control and regulating device 35.

Figure 8:
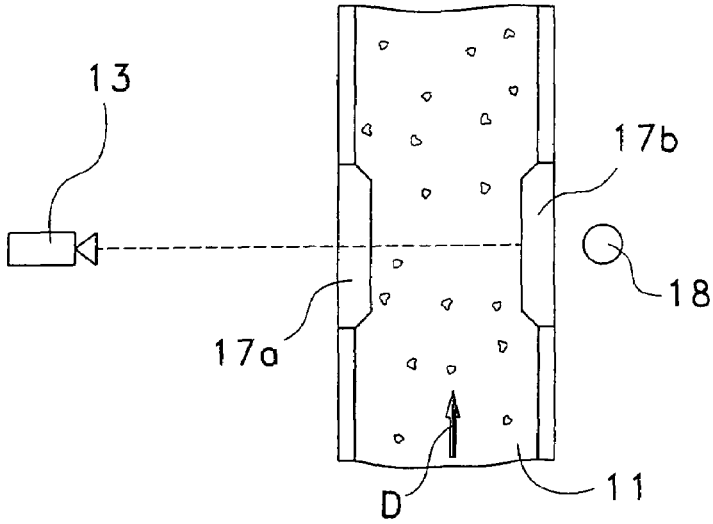
FIG. 8 shows a construction in which two glass panes are inset beyond the inner wall of the fibre transport duct into the fibre-air flow.
Figure 8A:
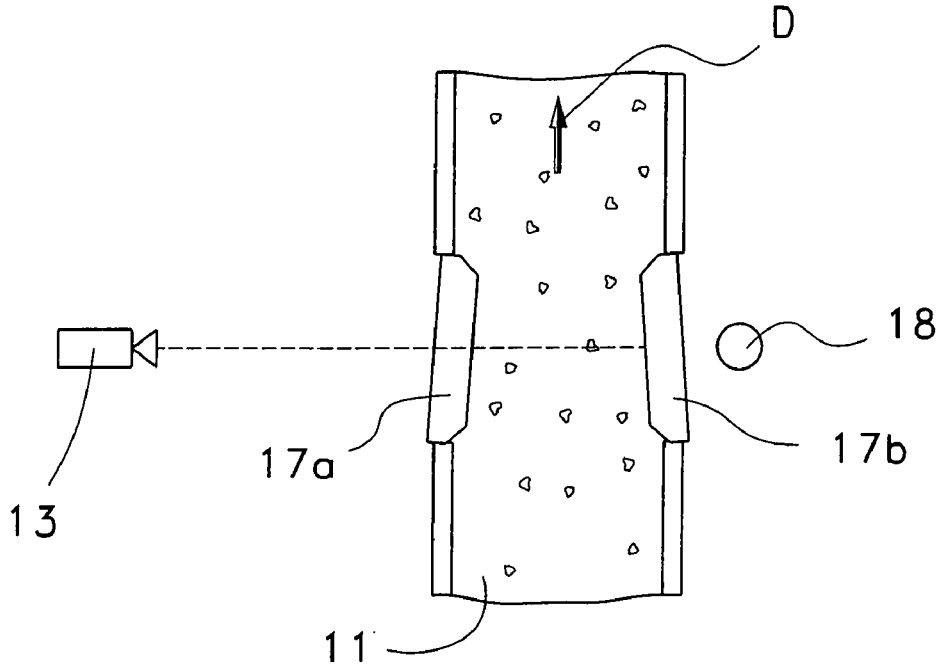
FIG. 8*a* shows a construction in which two opposing glass panes are inset into the fibre-air flow and set at an angle to it.

In the embodiment of FIG. 8, in the fibre transport duct 11 the glass panes 17*a*, 17*b* are set so far out into the fibre-air flow D that the cleaning action is achieved. The arrangement of FIG. 8 is also suitable for applications in which two opposing glass panes 17*a*, 17*b* have to be protected against contamination or where the view into the transport duct has to be from opposite or even offset opposite viewing directions. FIG. 8 shows a section through a rectangular duct. Here too, a camera 13 looks through a window 17*a* at a stream of material comprising fibre tufts 40, which are illuminated using the lighting equipment 18. For the cleaning action it is essential that the glass panes 17*a*, 17*b* project into the flow of material. It is a further advantage if the glass panes can be inclined at an angle again as shown in FIG. 8*a*.

Figure 9:
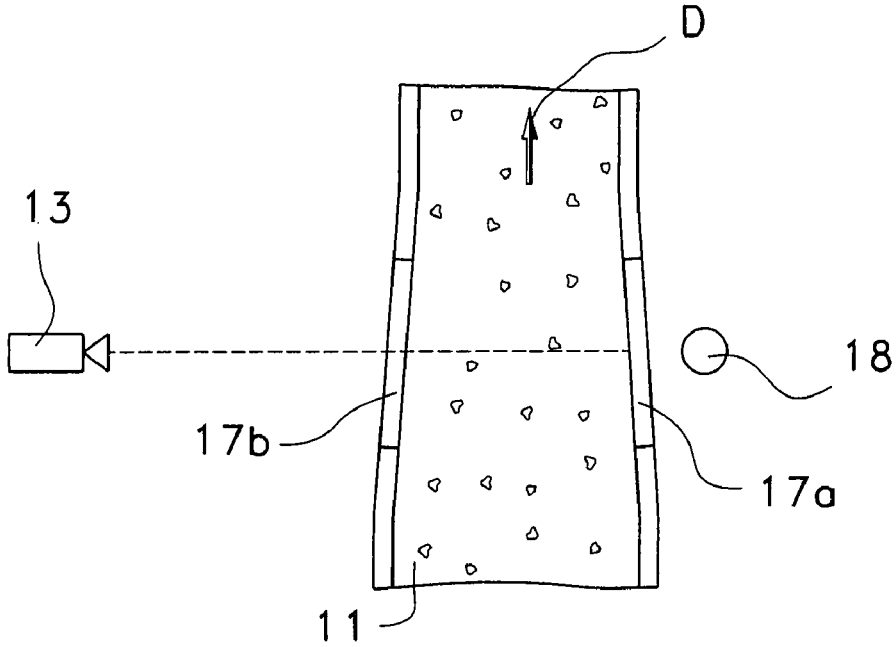
FIG. 9 shows a construction in which two opposing glass panes are arranged conically with respect to one another in the direction of the fibre-air flow, constricting the fibre transport duct.

Referring to FIG. 9, two opposing glass panes 17*a*, 17*b* in the wall of the fibre transport duct 11 are arranged tapering conically towards one another in the direction of the fibre-air flow D to constrict the fibre transport channel 11. This produces smoothly flowing lines. The advancing of the fibre-air flow D and the inclination of the panes 17*a*, 17*b* to the fibre-air flow D is achieved by a narrowing of the duct. In this case, smooth transitions can be achieved in a rectangular duct.

Although the foregoing invention has been described in detail by way of illustration and example for purposes of understanding, it will be obvious that changes and modifications may be practiced within the scope of the appended claims.

The invention claimed is:

1. An apparatus for detecting foreign objects in fibre material, comprising:

an enclosed pathway defined by wall surfaces adapted to transport the fibre material in a current of air, the wall surfaces of the enclosed pathway having at least one transparent region; and an optical sensor system arranged to detect fibre-air flow in said enclosed pathway through said transparent region, wherein at least a portion of said transparent region is inclined into the fibre-air flow and causes force-applying contact between the portion of the transparent region and the fibre-air flow.

2. An apparatus according to claim 1, wherein the transparent region comprises a window of glass or plastics material.

3. An apparatus according to claim 1, in which the transparent region is so oriented that the fibre-air flow is directed onto the transparent region.

4. An apparatus according to claim 1, in which the transparent region extends outward from the enclosed pathway into the fibre-air flow.

5. An apparatus according to claim 1, in which the inclination of the transparent region relative to the fibre-air flow comprises, at the transparent region, a constriction of the enclosed pathway in the direction of flow of the material.

6. An apparatus according to claim 1, in which the enclosed pathway has a rectangular or square cross-section or a circular cross-section.

7. An apparatus according to claim 1, in which the apparatus is arranged in a spinning preparatory plant and the enclosed pathway is a fibre transport duct or a feed chute.

8. An apparatus according to claim 1 in which the at least one transparent region comprises a first transparent region and a second transparent region opposite the first transparent region, and the apparatus further comprises lighting equipment, which shines light through the first transparent region into the enclosed pathway, and the optical sensor system arranged on the opposed side of the enclosed pathway for examining the fibre-air flow through the second transparent region.

9. An apparatus according to claim 1, wherein the at least one transparent region of the wall surfaces of the enclosed pathway comprises a transparent channel portion.

10. An apparatus according to claim 1, further comprising lighting equipment comprising at least one neon tube.

11. An apparatus according to claim 1, in which the optical sensor system comprises a matrix camera, or light sensors.

12. An apparatus according to claim 1, in which the apparatus is arranged in or downstream of a cleaning apparatus, in or downstream of a card, in or downstream of a foreign fibre separator, or in or downstream of a foreign part separator.

13. An apparatus according to claim 1, wherein the fibre material comprises tufts.

14. An apparatus according to claim 1, further comprising a source of polarized light for illuminating the fibre material.

15. An apparatus according to claim 1, in which a separation device for separating out the foreign objects is arranged downstream of the optical sensor system.

16. An apparatus according to claim 14, in which a depolarization is effected for detection.

17. An apparatus according to claim 15, in which the optical sensor system is connected by way of an evaluating device and a control device to the separation device and the separation device is controllable in dependence on signals from the optical sensor system.

18. An apparatus for detecting foreign objects in fibre material, in which the fibre material is transportable in a current of air through a pathway that is enclosed by wall surfaces having at least one transparent region and an optical sensor system is arranged to detect the fibre-air flow through said at least one transparent region, wherein said at least one transparent region with which the sensor system is associated extends into the fibre-air flow and the fibre-air flow is able to flow along said at least one transparent region in force-applying contact therewith, wherein the at least one transparent region is arranged in a support structure, which, with the at least one transparent region, is rotatable about its longitudinal axis.

19. An apparatus according to claim 18, in which the support structure comprises an aluminum extruded profile which, with the at least transparent region is rotatably arranged in a guide element.

20. An apparatus according to claim 18, in which inner surfaces of the at least one transparent region are arranged at a shallow angle in relation to the direction of the fibre-air flow.

* * * * *